US012128284B2

(12) United States Patent
Webster

(10) Patent No.: US 12,128,284 B2
(45) Date of Patent: Oct. 29, 2024

(54) SPORT EXERCISE DEVICE

(71) Applicant: Gregory Harold Webster, Chatham, NJ (US)

(72) Inventor: Gregory Harold Webster, Chatham, NJ (US)

( * ) Notice: Subject to any disclaimer, the term of this patent is extended or adjusted under 35 U.S.C. 154(b) by 0 days.

(21) Appl. No.: 17/847,079

(22) Filed: Jun. 22, 2022

(65) Prior Publication Data

US 2022/0314090 A1 Oct. 6, 2022

Related U.S. Application Data

(63) Continuation of application No. 16/776,490, filed on Jan. 29, 2020, which is a continuation of application No. 14/931,790, filed on Nov. 3, 2015, now Pat. No. 10,549,163.

(30) Foreign Application Priority Data

Nov. 3, 2014 (GB) ..... 1419720

(51) Int. Cl.
*A63B 69/00* (2006.01)
*A63B 102/14* (2015.01)

(52) U.S. Cl.
CPC ..... *A63B 69/00* (2013.01); *A63B 2102/14* (2015.10)

(58) Field of Classification Search
CPC ..... A63B 69/00; A63B 2102/14; A63B 59/20
USPC ..... 473/446
See application file for complete search history.

(56) References Cited

U.S. PATENT DOCUMENTS 5,186,699 A * 2/1993 Dimmig ..... A63B 21/00069 473/553
2008/0058129 A1* 3/2008 Herman ..... A63B 69/00 473/446
2015/0005113 A1* 1/2015 Day ..... A63B 60/00 473/513
2016/0263460 A1* 9/2016 Kreger ..... A63B 71/0045

* cited by examiner

*Primary Examiner* — Melba Bumgarner
*Assistant Examiner* — Amir A Klayman
(74) *Attorney, Agent, or Firm* — Franklin & Associates International Inc; Matthew F. Lambrinos

(57) ABSTRACT

A sport exercise device; for use with a sport stick, the sport stick having a head and a shaft. The device comprises a face, edge and attachment means. In one approach, the edge is adapted and arranged to surround the stick's head. The attachment means allows attachment of the device's face to hold an independently provided weight with respect to the head. The attachment means may allow attachment of the device's face to close the stick's net sufficient to prevent out-passage of a ball within the net.

13 Claims, 9 Drawing Sheets

SPORT EXERCISE DEVICE

CROSS REFERENCE TO EARLIER APPLICATIONS

This application is a continuation of U.S. Non-Provisional application Ser. No. 16/776,490, filed 29 Jan. 2020, which is a continuation of US Non-Provisional application Ser. No. 14/931,790, filed 3 Nov. 2015, now U.S. patent Ser. No. 10/549,163, issued 4 Feb. 2020, which claims priority under 35 U.S.C. § 119 to GB patent application no. 1419720.6 filed Nov. 3, 2014, the disclosure of each of the aforementioned applications is incorporated herein by reference in its entirety.

TECHNICAL FIELD

The present invention relates to a sport exercise device; in particular for training with a sport stick; more particularly but not exclusively a device for adding weight to a sports stick for exercise or training purposes.

BACKGROUND

Increasing interest in maintenance of health through exercise and team sports has led to increasing interest in a variety of sports. Lacrosse is known for health benefits as well as team spirit and has been one of the fastest-growing team sports where for example in 2013, nearly 750,000 players participated in lacrosse on organized teams, being an increase of nearly 25,000 players from the year before.

When not playing with others, solo training in team sports can be difficult to achieve.

PRIOR ART

Accordingly a number of patent applications have been filed in an attempt to resolve the problem or similar, including the following:

Granted European patent EP 2 269 703 (ENDAY) discloses an exercise racquet to aid in the playing development of the user. The racquet incorporates a handle and a solid planar member extending from the handle. The planar member has a centrally located stabiliser member including a longitudinally concave length located on both surfaces of the planar member, the longitudinal concave length having curved wings with downwardly extending shoulders so that the planar member provides resistance to the racquet being stroked through the air and a stabiliser member to prevent the racquet from lifting.

United States patent application US 2008 058 129 (HERMAN) discloses a lacrosse practice aid for use with a lacrosse stick assembly including a lacrosse stick, a lacrosse head having a head base, head sidewalls, and a head lip, a netting element attached to the lacrosse head, and a lacrosse ball positioned within the netting element. The lacrosse practice aid includes a rear cover portion including a rear neck portion and a rear head engagement portion and a flexible front cover portion including a front neck portion, a front head engagement portion, and a front center flex region. The flexible front cover portion is in communication with the rear cover portion to form a head engagement pocket configured to secure the lacrosse head within. The front center flex region comprises a flexible surface such that the lacrosse ball is retained within the lacrosse head while providing an extended range of ball handling feel. The front neck portion and the rear neck portion form a neck perimeter.

United States patent application U.S. Pat. No. 5,186,699 (DIMMIG) discloses a light weight plastic "pan-like" device is attached to any sports swung implement. When attached, the implement is swung in any of the normal stroking motions. The device produces air resistance against the intended motion. With regular, repetitive exercise the arm, shoulder, and back muscles are strengthened. Functional exercise is achieved aerodynamic drag. The devices may be adjustable for a greater or lesser amount of resistance. The devices are quickly locked into place with a simple attachment means. The devices maximize the resistance per unit surface by minimizing weight and optimizing the air capturing features.

SUMMARY

According to one aspect, there is provided a sport exercise device; for use with a sport stick having a head and a shaft; wherein said device comprises a face, edge and attachment means, and wherein the edge surrounds the stick's head and the attachment means allows attachment of the device's face to hold an independently provided weight with respect to the head.

DETAILED DESCRIPTION OF PREFERRED EMBODIMENTS

Figure 1A:
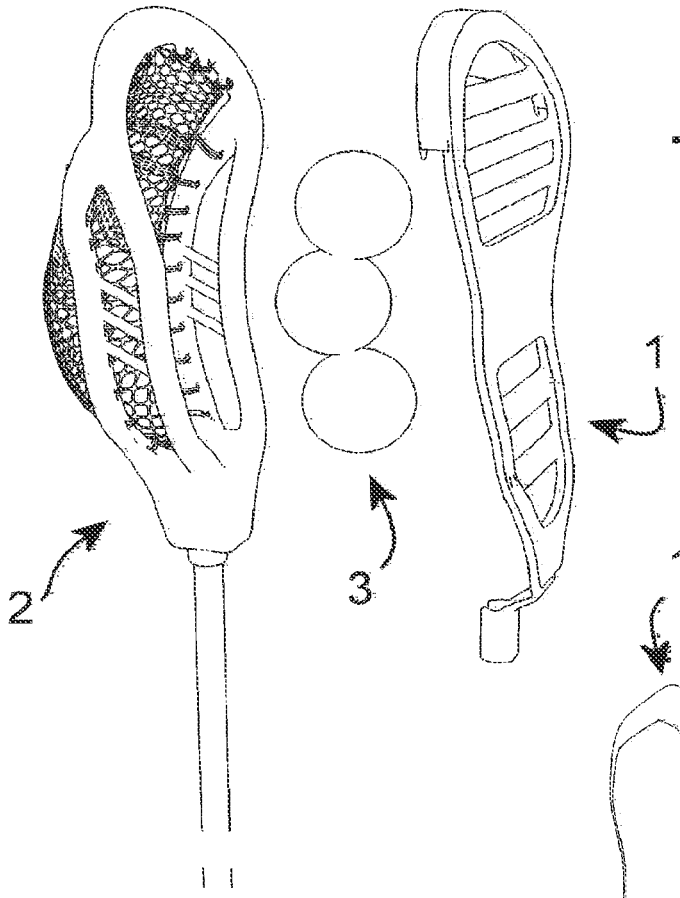
FIG. 1A shows an exploded isometric view of a first embodiment of the device in use.

In some embodiments the face may provide a flexible or fixed pouch for the weight. Such pouch may be elastic and configured to pull the weight against the stick's head.

In one embodiment, the present technology is for use with a sport stick having a frame, a shaft, and an open net depending from the frame; wherein said device comprises a face, edge and attachment means, and wherein the edge surrounds the stick's frame and the attachment means allows attachment of the device's face to close the stick's net sufficient to prevent out-passage of a ball within the net.

In some embodiments such device is in the field of lacrosse, wherein the stick is a lacrosse stick and the ball is a lacrosse ball. In other embodiments other sports sticks may be envisaged, For example other sports wherein the stick has an open depending net. Advantageously the ball is of an appropriate size to the stick.

In this way the face covers part or whole of the net such that the net is closed at least in part. In some embodiments a majority of the net may be left sufficiently open to allow passage of air and consequently allow naturalistic movement of the stick during training or practice movements.

This advantageously means that the net may be used to store weights, wherein such as lacrosse balls are easily available and relevant.

In this way the device may be used for practising lacrosse playing movements, with extra weight.

Optionally, the attachment means is arranged perimetrically about the face so as to allow freedom of construction and in some embodiments centrally permit movement.

In some embodiments central spurs or projections may project towards the net so as to segment the net space below the face, and maintain weights or balls in relative positions during movement. Advantageously this prevents or limits movement of the weights during movements of the stick in exercise.

In some embodiments the attachment means comprises the edge. In such embodiments the edge may comprise at least one clip mechanism over the frame. Such clip mechanism may comprise resiliently deformable parts and/or tolerance fit parts. In other embodiments flexible or elastic components may allow such components to be displaced repeatedly over the head so as pull the face over for closure.

In some embodiments the clip mechanism comprises a number of clips and/or components arranged around the edge, or continuous along at least part of the edge.

In other embodiments in addition or the alternative there may be provided a lip or fixed catch which catch is manoeuvred into position so as to hold the face against the head.

In some embodiments the attachment means is configured to attach to the shaft, for example wherein the attachment means comprises a clamp or catch configured for progressive or articulated interface with a tubular member.

Ideally such progressive interface or attachment comprises a mechanism for stabilising the interface so as align the face to the head progressively.

Such interface may comprise an in use attachment comprising a circular ring with displaceable section, for example with a gate or living hinge, or part-circular jaws with sufficient flexure to allow entrance of the member. Advantageously therefore the jaws or ring can be closed onto or over the member in use, and opened to displace the attachment means from the stick for transport or storage.

In such embodiments or similar the device may comprise sprung parts, configured to extend under force.

For example the jaws may be comprised two extensions extending orthogonally from a body extending axially from a plane defined by the edge, wherein in use the edges are parallel with and typically in contact with the frame.

In other embodiments the attachment comprises a fixed circular ring or jaws, which attachment requires axial entrance along the shaft.

Typically the face is rigid or non-flexible wherein the attachment means is not liable to be compromised at any point by flexure of the face.

In other embodiments the face is flexible at least in part to accommodate movement in the net or weights or balls.

Typically the face is planar, wherein the frame is capped by the face and an enclosed area created wherein the stick may be laid down on a flat surface for transport or storage.

In some embodiments the face is perforated so as to reduce costs and air resistance. Advantageously the perforated face means that air passes easily through the face as well as the net, wherein round balls in the net further present minimal air resistance.

In some embodiments the face is configured for maximal air resistance, for example being solid and/or sculpted at least in part.

In some embodiments the face is deformable under sufficient pressure from the balls.

In some further embodiments the edge comprises flexible detachable or displaceable parts such as straps, which straps are configured to reach from one point of the edge to another point and pulls the edge onto the frame. In addition or the alternative such straps are configured to pull the net tighter, and so as to thereby hold balls tight to the face.

Further embodiments the catch extends fixedly or flexibly towards the shaft to the other side of the net from the face, so as to sandwich the net and consequent balls or weights held therein.

Referring to the accompanying Figures, in some embodiments, the device 1 is conceived as a single moulded form (plastic or polymer such as polyethylene or acrylonitrile butadiene styrene) that is manually attached or detached to a lacrosse head 2 and shaft 20 and serves to cover the lacrosse stick head and netting 22.

The device dimensions will conform to standards for example in the United States the NCAA (National Collegiate Athletic Association) and NFHS (National Federation of State High School Associations) head dimensions and therefore allow for a secure fit. The plastic construction allows the device to be; (i) multi-colour or translucent (ii) logo compatible and (iii) lightweight.

The device allows a user to place one to three lacrosse balls 3 (5 oz.-5.5 oz./140-156 grams per ball) into the netting then securing them. The added weight to the head will allow the player to perform aggressive stick skill routines without losing a ball or balls from the head, simulating shots with ball release which then improves strength and shot speed and muscle memory which are the exercise benefits.

In this way in some embodiments the face may include a displaceable or deformable section, for example centrally, wherein the section is deformed under sufficient pressure from a ball.

The results from utilising the device include; (targeted shooting muscle development, (ii) advanced stick skill development and (iii) accelerated shot speed.

Figure 1B:
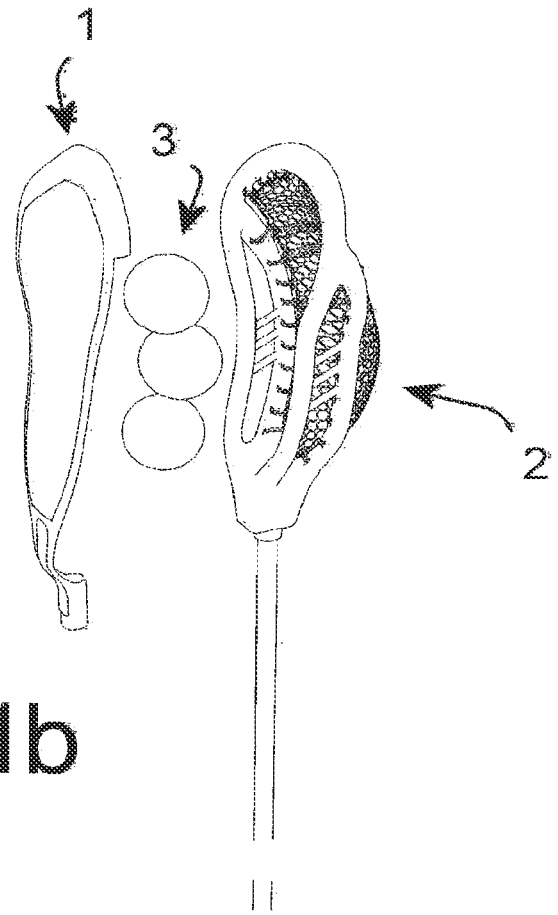
FIG. 1B shows an exploded isometric view of a second embodiment of the device in use.
Figure 2A:
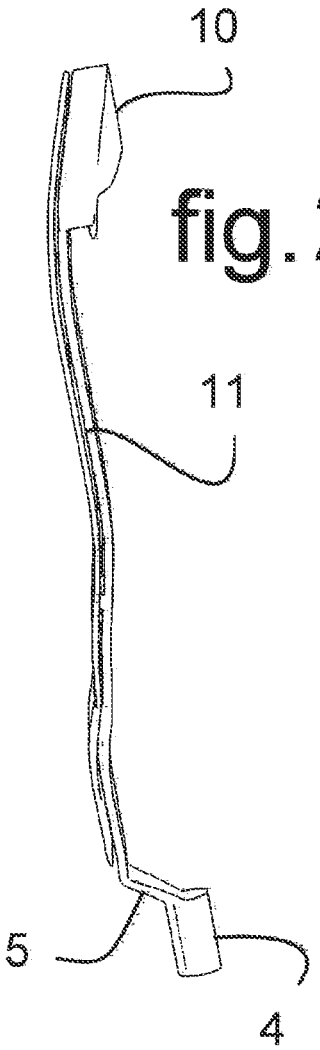
FIG. 2A shows a side view of the first embodiment as shown in FIG. 1A.
Figure 2B:
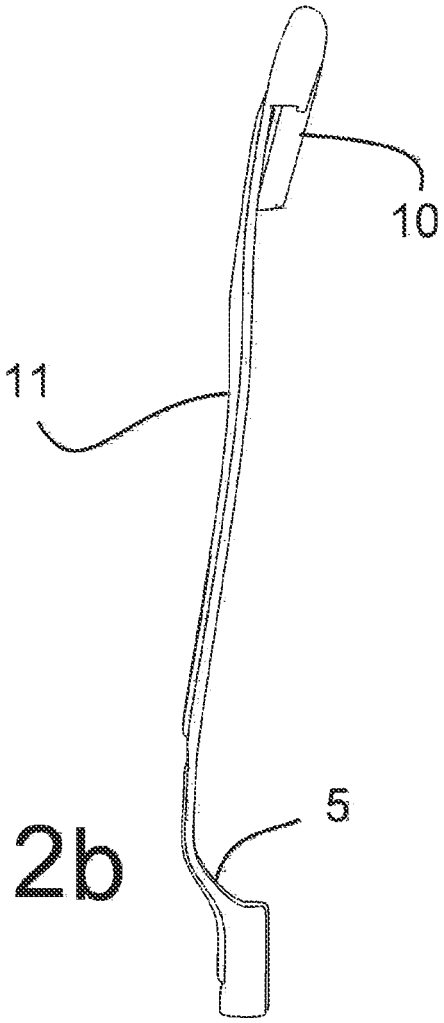
FIG. 2B shows a side view of the second embodiment as shown in FIG. 1B.
Figure 3A:
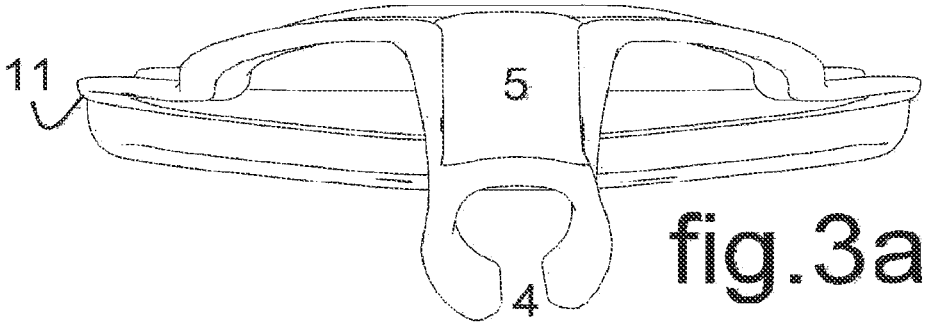
FIG. 3A shows an end view of the second embodiment.
Figure 3B:
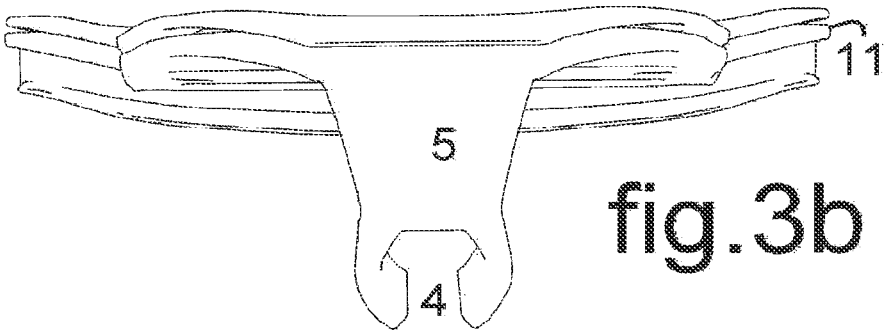
FIG. 3B shows a reverse end view of the embodiment shown in FIG. 3A.
Figure 3C:
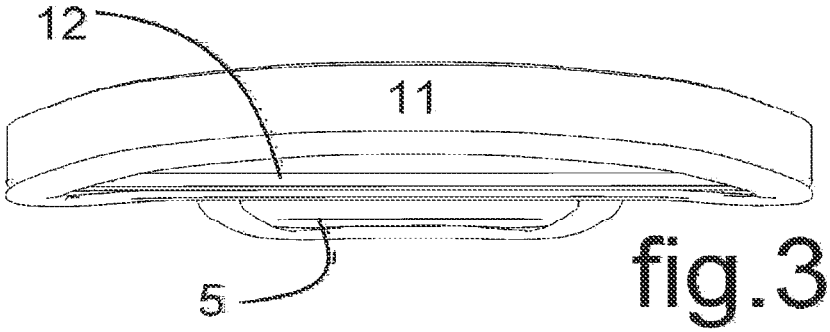
FIG. 3C shows an end view of the first embodiment.
Figure 3D:
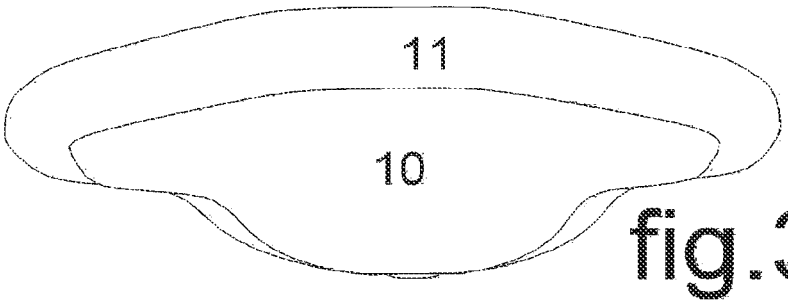
FIG. 3D shows a reverse end view of the embodiment shown in FIG. 3C.
Figure 4A:
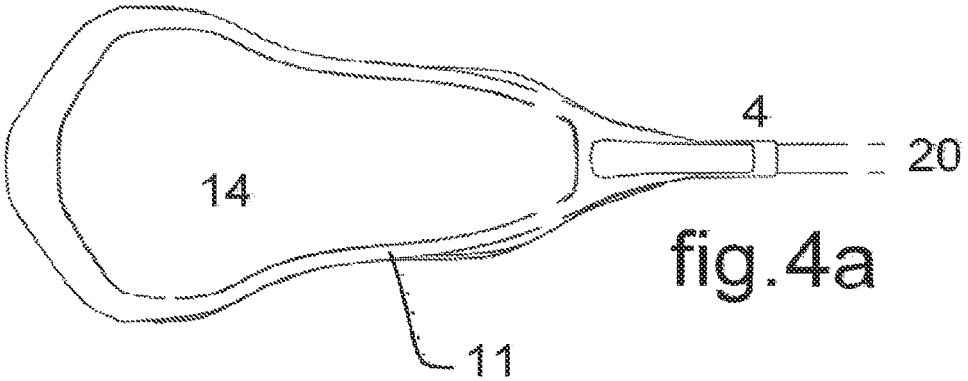
FIG. 4A shows a plan view from above of the second embodiment in use.
Figure 4B:
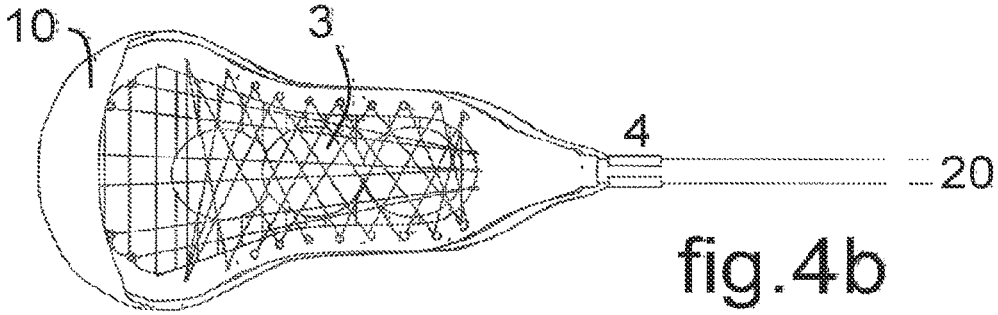
FIG. 4B shows a plan view from below of the embodiment shown in FIG. 4A.
Figure 4C:
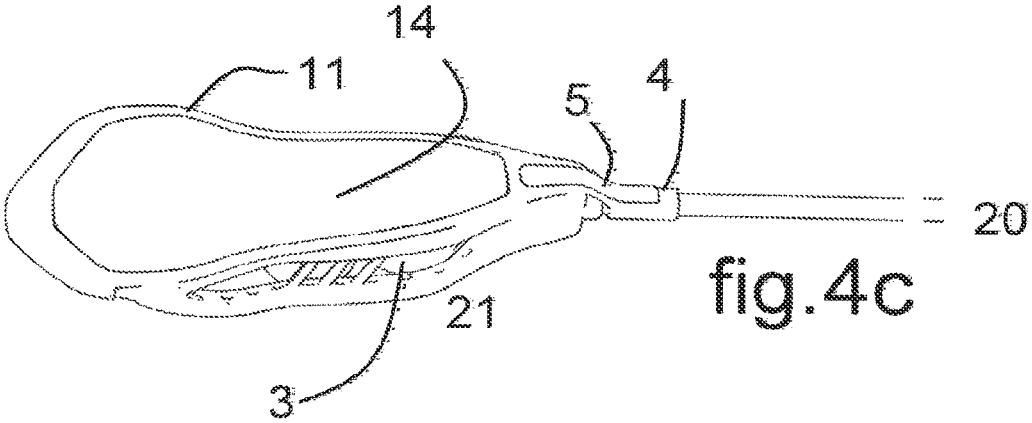
FIG. 4C shows an isometric view of the embodiment shown in FIG. 4A.
Figure 5A:
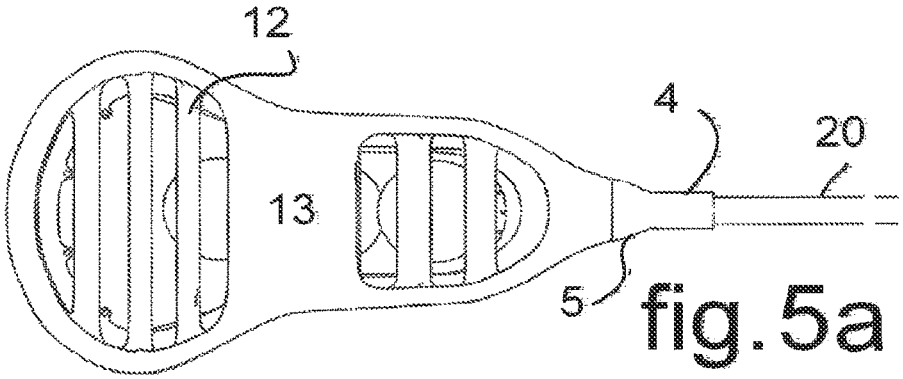
FIG. 5A shows a plan view from above of the first embodiment in use.
Figure 5B:
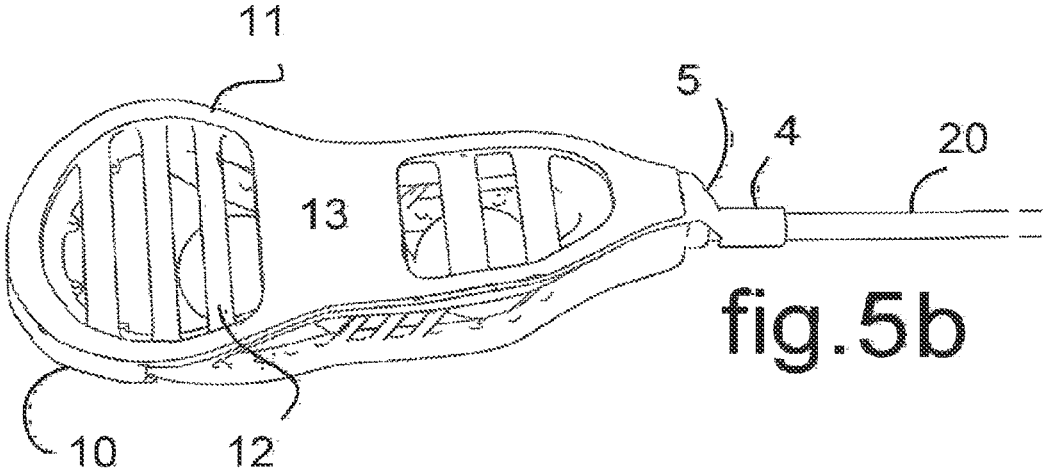
FIG. 5B shows an isometric view of the embodiment shown in FIG. 5A.
Figure 5C:
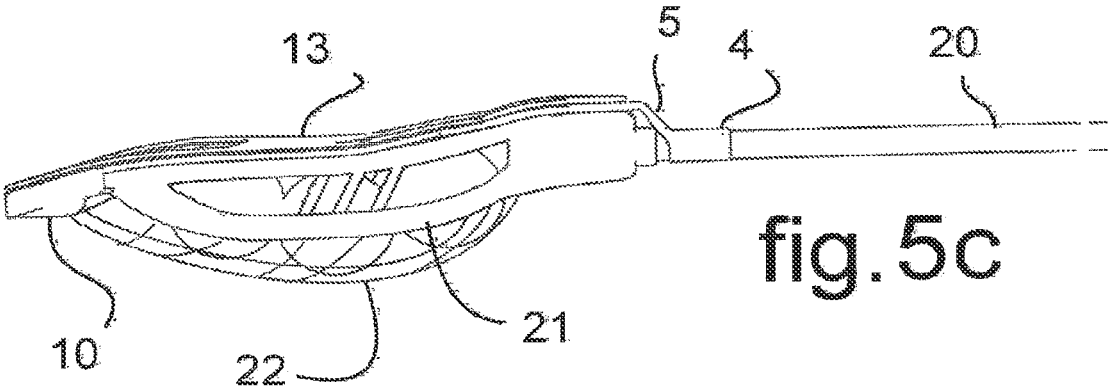
FIG. 5C shows a side view of the embodiment shown in FIG. 5A.
Figure 6A:
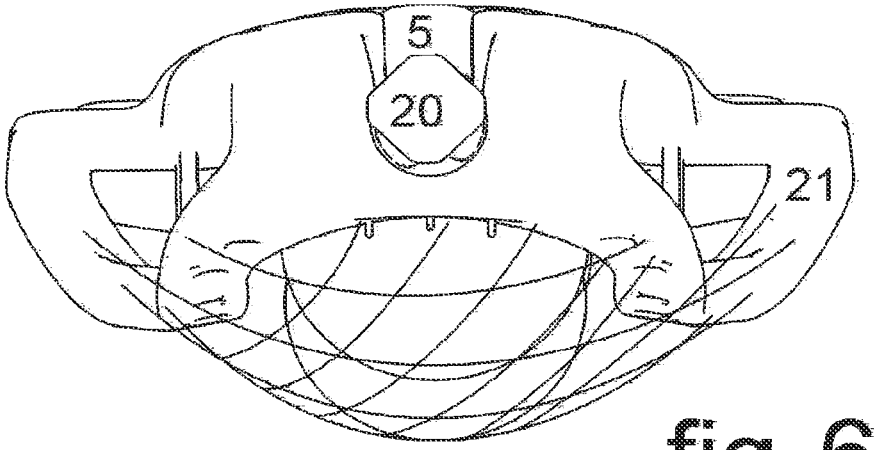
FIG. 6A shows an end view of the first embodiment in use as shown in FIG. 1A.
Figure 6B:
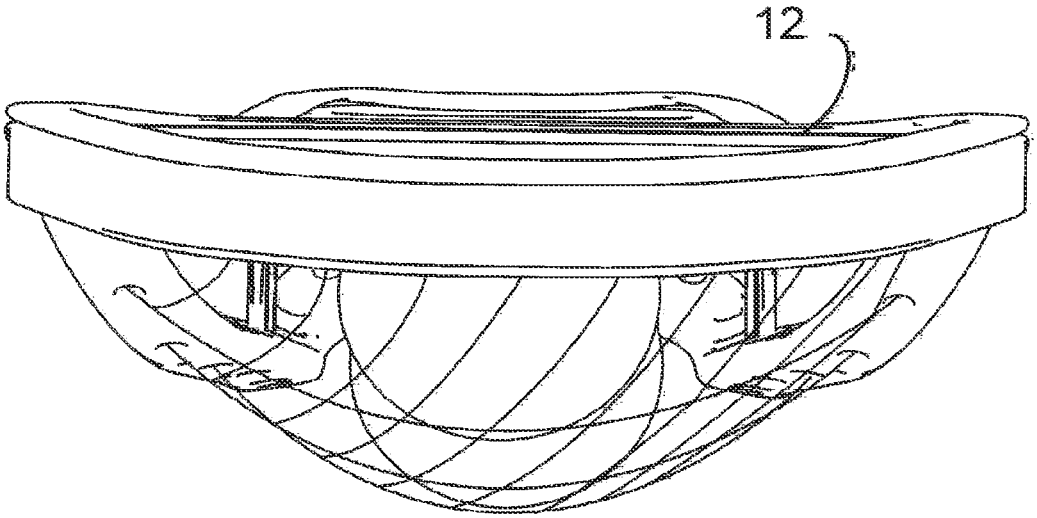
FIG. 6B shows a reverse end view of the first embodiment as shown in FIG. 6A.
Figure 7A:
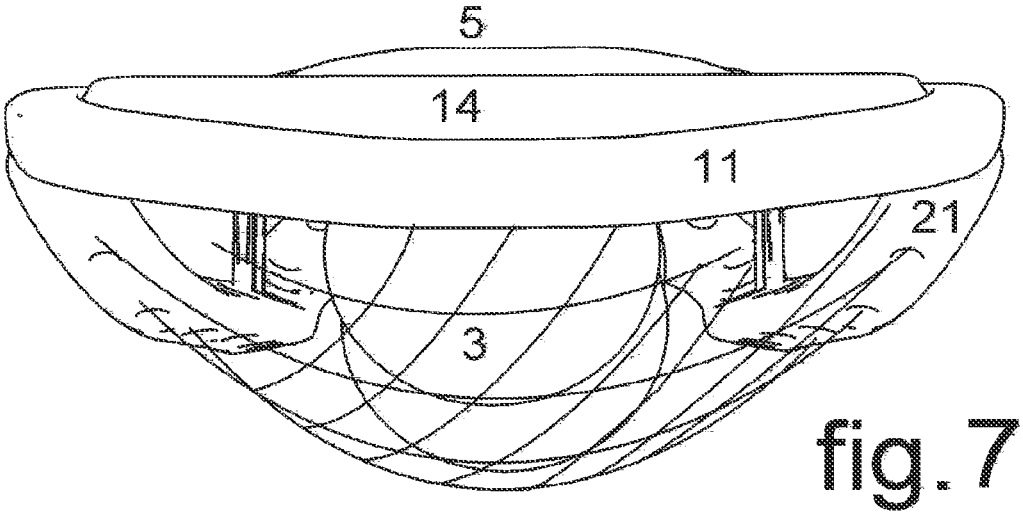
FIG. 7A shows an end view of the second embodiment in use as shown in FIG. 1B.
Figure 7B:
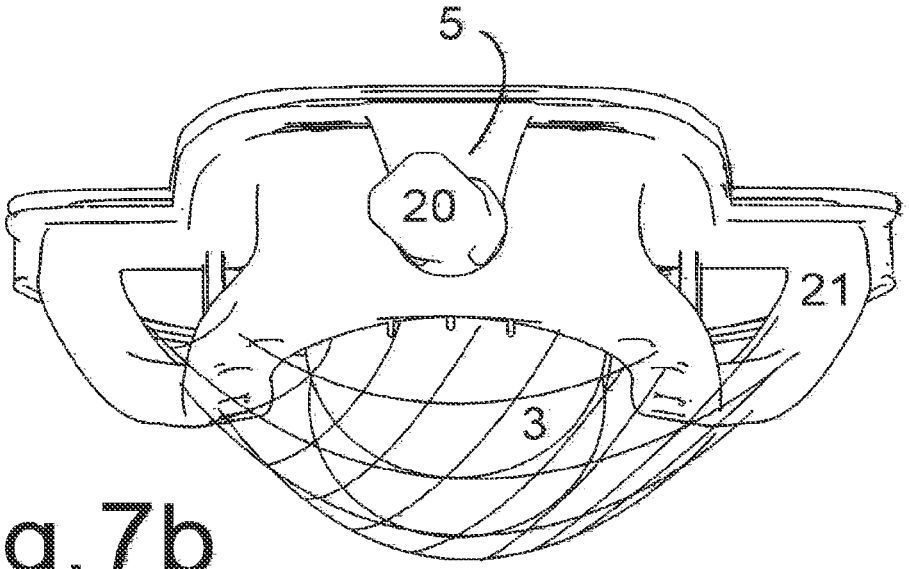
FIG. 7B shows a reverse end view of the second embodiment as shown in FIG. 7A.
Figure 8A:
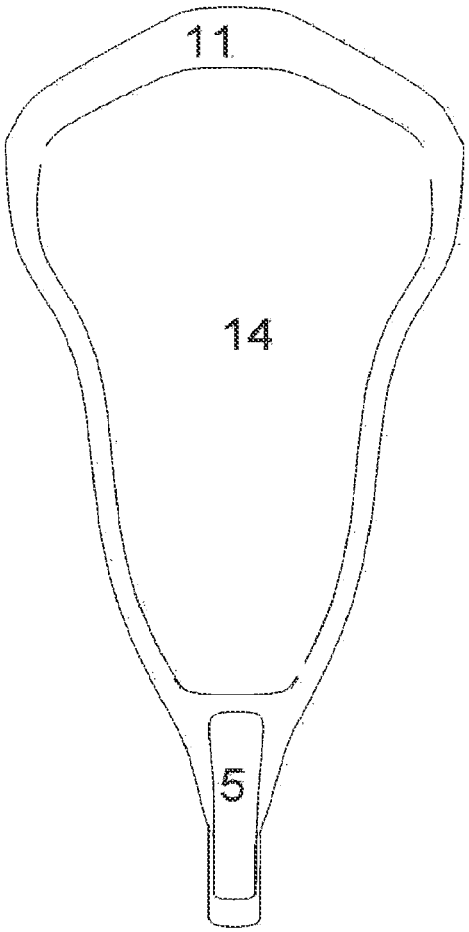
FIG. 8A shows a plan view of the second embodiment.
Figure 8B:
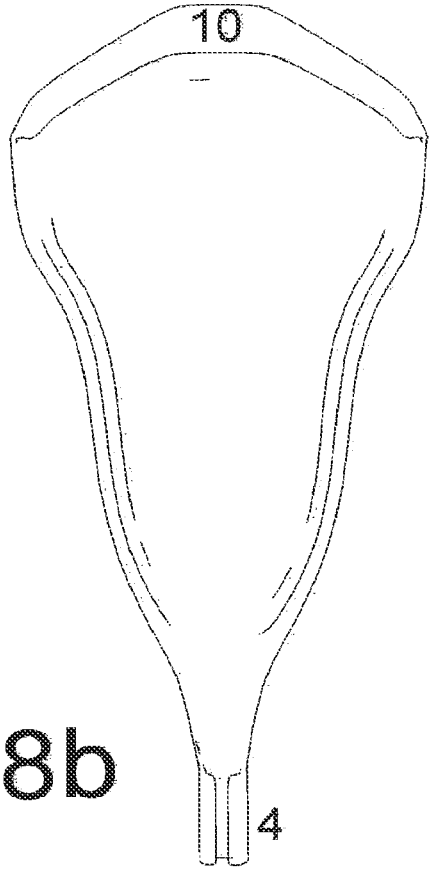
FIG. 8B shows a plan view from below of the embodiment shown in FIG. 8A.
Figure 9A:
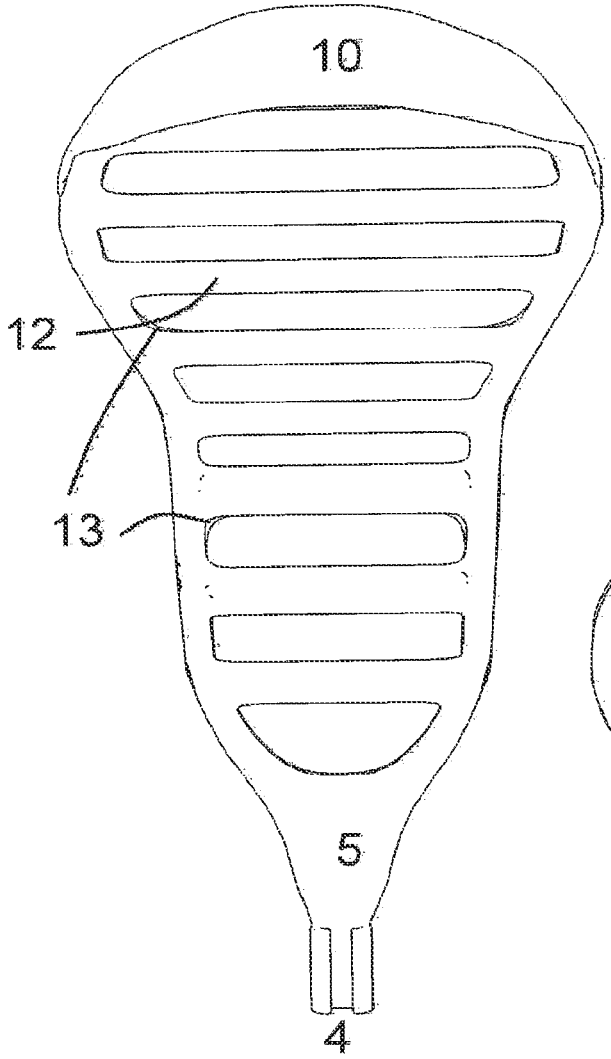
FIG. 9A shows a plan view of the first embodiment.
Figure 9B:
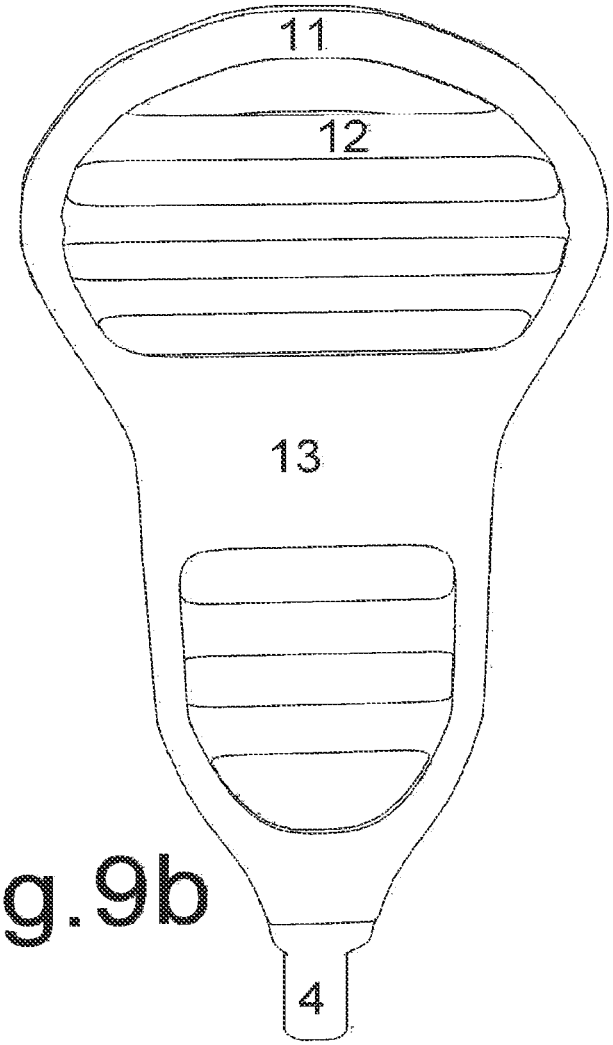
FIG. 9B shows a plan view from below of the embodiment shown in FIG. 9A.

With reference to FIG. 1 there is shown a typical lacrosse stick with the device attached and balls held in the stick so as to aid in exercise moves by adding weight to the stick at its end, and so increasing difficulty of maneuvering the stick through normal or standard manoeuvres.

The stick is formed of a frame 2 and shaft 20, with the frame supporting the netting 22. The frame angles away from the shaft, with a curved outer facing surface and side netting supportive bracing 21 depending from the surface so as to provide a minimum depending depth.

With reference to the figures there is shown an embodiment of the device 1 comprising a closed flat or perforated face, and bipartite attachment means. The bipartite attachment means comprises a shaft attachment means and a frame attachment means.

The frame attachment means comprises a fixed lip catch extending from the edge 11 for placement over the frame's distal end from the shaft.

The frame attachment is a continuation of the edge and is situated distally on the edge from the shaft attachment, wherein the edge describes an ovaloid form corresponding to the frame form.

The frame attachment means comprises an extension of the edge around the frame at its distal point from the shaft, and advantageously therefore provides torsional rigidity to the face by attaching the device to the frame along an axis defined by the longitudinal axis of the frame.

The device is a predominantly a single-shot mould and formed from a synthetic plastics with a degree of resilient deformation in correct weight. The catch is a thicker weight to the face 13-14, and the attachment means for the shaft comprises a thinner weight C-clip 4 configured for deformation in use for attachment around the shaft.

The stick attachment clip therefore deforms for acceptance of the cylindrical shaft and reforms thereafter so as to require force to deform again and detach. The clip consequently forms a pair of semi-circular discontinuous jaws having distal switchbacks for urging under force by the stick. The jaws are supported on a spur 5 extending from the face.

In some further embodiments the shaft attachment means is integral or continuous ring wherein the shaft needs to be slid axially into the ring and the frame attachment means attached over the frame, for example wherein the device comprises a sprung expansion means.

In other embodiments the ring may be formed in use, wherein the ring comprises a displaceable gate.

The attachment means consists of a shaft attachment wherein the shaft attachment is a pair of curved arcuate jaws which extend orthogonally from a spur extending from the edge and together describe an incomplete circle dimensioned to accept and substantially surround the shaft at rest.

The jaws define a central segment aperture substantially parallel to the spur which segment opens further in use to accept the shaft during attachment. The jaws are therefore configured to flex open to widen said aperture.

The jaws are resiliently deformable plastics configured to spring back after acceptance of the shaft or attachment to the stick.

The jaws have mouth parts that are curved so as to progressively accept the curvature of the shaft as inserted into the aperture and smoothly and progressively displace and return after.

The faces have a heavier weight edge so as to avoid excessive deformation of the central area of the face in use. In some further embodiments the central area of the face depends towards the netting so as to maintain the netting tight and balls fixedly located.

In such embodiments the device may comprise a face having an inner surface and an outer surface wherein the outer surface in use is a planar cover to the lacrosse stick's net and frame, and the inner surface cooperates with the lacrosse stick's net to maintain the balls in a pouched space.

The face follows the frame shape, namely wherein the frame deviates from an angle defined by the stick predominant axis, defined in turn by the shaft.

In this way the frame attachment means is placed over the distal frame edge and the clip is clipped over the shaft wherein sufficient adjustment is possible in the catch, clip and spur to permit the face to be pulled against the frame in attachment.

The edge follows the frame closely and parallel to it, so as to minimise chances of the balls escaping.

The edge is rigid so as to prevent the face buckling or curving. The edge is stepped or deviated from a straight axis, wherein the longitudinal axis of the shaft is discontinued or deviated from by the head's axis.

The first embodiment has a perforated face, so as to reduce costs and air resistance in use. The face is comprised of a number of bars 12 arranged laterally across the longitudinal axis joining edges. A central support 13 is comprised of a lateral wider area reaching laterally across between edges and acting to strengthen the face against buckling from the ball or movement centrally.

The invention has been described by way of examples only and it will be appreciated that variation may be made to the above-mentioned embodiments without departing from the scope of invention. Firstly it will be understood that any features described in relation to any particular embodiment may be featured in combinations with other embodiments.

With respect to the specification therefore, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention, with variation and implementation obvious and clear on the basis of either common general knowledge or of expert knowledge in the field concerned. Further, since numerous modifications and changes will readily occur to those skilled in the art, it is not desired to limit the invention to the exact construction and operation shown and described, and accordingly, all suitable modifications and equivalents may be resorted to, falling within the scope of the invention as set out in the accompanying claims. The present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

The invention claimed is:

1. A trainer device for use with a lacrosse sport stick having a shaft, a head frame, and an open-fronted net disposed about a rear portion of the head frame, wherein the trainer device comprises:

a face, edges, and an attachment; wherein the edges border the face and follow a structural perimeter of the head frame; and wherein the attachment is configured for attaching the face to the head frame;

the face is configured such that the open fronted net of the lacrosse stick is at least partially closed by said face of the trainer device when the trainer device is attached to the lacrosse stick by the attachment such that the face selectively retains at least an independently provided weight within the open fronted net and prevents out-passage of said independently provided weight from the open fronted net;

the face comprises a plurality of bars extending laterally and joining the edges and a plurality of apertures between the plurality of bars;

the face comprises a central support extending laterally and joining the edges;

the central support is longitudinally wider than each of the plurality of bars;

the device is adapted such that when the face is attached to the head frame, the head frame is capped by the face; and the device is adapted to leave a rearward portion of the net uncovered, and the net sufficiently open to allow passage of air there past and consequently allow naturalistic movement of the stick during training or practice movements.

2. A device according to claim 1 wherein the edges are adapted and arranged to surround the head frame and the attachment allows attachment of the device's face to close the stick's net sufficient to prevent out-passage of a ball within the net.

3. A device according to claim 1 wherein the attachment is arranged at least in part perimetrically about the face.

4. A device according to claim 1 wherein the attachment is configured to attach to the shaft.

5. A device according to claim 4 wherein the attachment comprises a resiliently deformable clip.

6. A device according to claim 4 wherein the attachment comprises a clip mechanism, wherein the clip mechanism comprises a number of clips and/or components arranged around the edges.

7. A device according to claim 4 wherein the attachment comprises a continuous ring and wherein the continuous ring comprises a displaceable gate.

8. A device according to claim 4 wherein the attachment comprises an annular part.

9. A device according to claim 1 wherein the edges comprise flexible detachable parts.

10. A device according to claim 1 wherein the face includes a deformable section for deformation away from the head under sufficient pressure.

11. A method of training with a lacrosse stick comprising:

attaching a trainer device according to claim 1 to the lacrosse sports stick; and training with the trainer device.

12. An apparatus comprising:

a lacrosse stick; and a device according to claim 1;

wherein the device is attached to the lacrosse stick.

13. A device according to claim 1, wherein the central support is adapted to strengthen the face against buckling from the weight or movement centrally.

* * * * *